US006623295B2

(12) United States Patent
DeLadurantaye, III

(10) Patent No.: US 6,623,295 B2
(45) **Date of Patent: *Sep. 23, 2003**

(54) PERSONAL COMPUTER TO HOME AUDIO DIRECT CONNECTING ADAPTER

(76) Inventor: Robert J. DeLadurantaye, III, P.O. Box 48793, St. Petersburg, FL (US) 33743

( * ) Notice: Subject to any disclaimer, the term of this patent is extended or adjusted under 35 U.S.C. 154(b) by 0 days.

This patent is subject to a terminal disclaimer.

(21) Appl. No.: 10/051,206

(22) Filed: Jan. 18, 2002

(65) Prior Publication Data

US 2003/0139089 A1 Jul. 24, 2003

(51) Int. Cl.[7] ..... H01R 11/00
(52) U.S. Cl. ..... 439/502; 439/638
(58) Field of Search ..... 439/623, 502, 439/505, 638, 639

(56) References Cited

U.S. PATENT DOCUMENTS 5,775,939 A * 7/1998 Brown ..... 439/502

OTHER PUBLICATIONS

Radioshack Product Catalog, Items #42–2620; 42–2551.*

* cited by examiner

*Primary Examiner*—Alexander Gilman
(74) *Attorney, Agent, or Firm*—Fowler White Boggs Banker, P.A.; Dennis L. Cook, Esq.

(57) ABSTRACT

An improvement over the prior art consisting of an adapter for connection into the audio output jack (mini stereo jack) of a personal computer. The adapter having a male mini stereo jack for connection into the PC sound board, such male jack making direct connection to dual RCA output cables for connection to other audio equipment, and also having a female mini stereo jack for reception of standard PC sound equipment such that home audio equipment can be easily hooked up to the PC without disconnecting the PC audio equipment.

3 Claims, 3 Drawing Sheets

PERSONAL COMPUTER TO HOME AUDIO DIRECT CONNECTING ADAPTER

CROSS-REFERENCE TO RELATED APPLICATION

Not Applicable

FIELD OF THE INVENTION

The present invention relates to the field of devices used to connect personal computers to other devices and, more specifically, to an electrical device that attaches to the sound card input jack of a personal computer that allows direct connection to home audio equipment without disconnection of the computer sound output equipment.

BACKGROUND OF THE INVENTION

With the advent of high quality stereo sound being placed over the Global Information Network computer users are now able to listen to radio stations from around the world, and extremely high quality digitally recorded and transmitted music can now be downloaded from a variety of sources that is growing every day. This has brought on a proliferation of computer speaker and sound systems that plug into the mini stereo jack (3.5 mm) universally found on soundcards in personal computers. However, when a listener wants to listen to this high quality music on his or her own home stereo equipment, they must first disconnect the computer speakers, then arrange multiple adapters to reconfigure the mini stereo plug found on personal computers, to the high quality RCA cables associated with home audio equipment.

This constant connecting and disconnecting can be frustrating for the typical user who may have to struggle with numerous other cables and wires coming from the back of the typical computer in order to reach the soundcard output jack. The constant connecting and disconnecting can easily lead to system failure by damaging the connections of the female soundcard stereo jack.

In patent application 09/840,681 an adapting device which allowed a user to insert the disclosed adapter permanently into the female jack of the personal computer soundcard and then connect the computer speakers to the adapter and have left and right stereo female RCA cable connectors, available to connect any variety of home audio equipment to the personal computer was disclosed by this inventor and such disclosure is fully incorporated into this application. The adapter of that invention required an additional connection between the adapter's female RCA connectors and the RCA cables coming from the home audio equipment, creating increased resistance and possible power and fidelity loss. The device of this invention solves this problem by allowing a user to insert this adapter permanently into the female jack of the personal computer soundcard and then connect the computer speakers to the adapter and have left and right stereo RCA cables, which are also available to connect directly to any variety of home audio equipment.

A number of patents in the prior art disclose various computer audio interfaces but none have the simplicity and ease of use of the invention disclosed herein.

For example, U.S. Pat. No. 5,775,939 issued to Brown on Jul. 7, 1998, titled "Interface Assembly for Peripheral Accessories" discloses an accessory connector and adaptor assembly that utilizes a connection to the reference voltage line of the interface between a personal computer and its keyboard or other accessory, thereby avoiding the need to provide an independent power supply circuit for peripheral devices and accessories such as a microphone, speakers or the like. The adapter assembly is configured with a first interface having, by way of illustrative example, a male connector portion dimensioned for insertion into the keyboard port or PS2 port of a personal computer, and a female connector portion dimensioned to accommodate the male termination of a conventional keyboard cable. The adapter assembly further includes a second interface for providing power to the one or more external peripheral devices. By way of illustrative example, the second interface may include one or more jacks, male or female, to accommodate the terminating connector of a cable associated with one or more audio speakers and/or a loudspeaker. As a further example, a first connector of second interface will connect to an audio peripheral input located at the rear of a processing unit of the computer, and an accessory conductor plug of a microphone will connect to a second connector.

Also, U.S. Pat. No. 5,573,425, issued to Morisawa, et al. on Nov. 12, 1996, titled "Communication Cable Used in a Computer System" discloses a communication cable used to connect a peripheral device to a computer that has a first cable, a second cable and a patch unit. The first cable encloses a set of power lines and a set of data lines; the second cable also encloses a set of data lines. The patch unit includes a socket with first and second contacts. In the patch unit, the sets of data lines of the first and second cables are connected. One of the power lines is connected to the first contact, and another of the power lines is connected to the second contact. The first cable connects the patch unit with the peripheral device, and the second cable connects the patch unit with the computer. When power is applied from an external source to the first and second contacts, the power is supplied from the first and second contacts to the peripheral device.

As the above background reveals, there is a need for a device that enables the user of a personal computer to connect the audio output of the computer to home audio equipment without disconnecting the computer audio output equipment, that is convenient and easy to use.

Therefore, it is an object of this invention to supply a simple device that combines male and female mini stereo jacks with RCA cables such that a personal computer user can permanently connect home audio equipment and computer audio equipment at the same time.

SUMMARY OF THE INVENTION

The invention is an improvement over the prior art consisting of an adapter for connection into the audio output jack (mini stereo jack) of a personal computer, such that the adapter, having a male mini stereo jack for connection into the PC sound board, makes a direct connection to dual RCA output cables for direct connection to other audio equipment; and also having a female mini stereo jack for reception of standard PC sound equipment such that home audio equipment can be easily hooked up to the PC without disconnecting the PC audio equipment.

BRIEF DESCRIPTION OF THE DRAWINGS

Other objects, features, and advantages of the present invention will become apparent from the detailed description of the invention, which follows, when considered in light of the accompanying drawings in which.

DESCRIPTION OF THE PREFERRED EMBODIMENT

Figure 1:
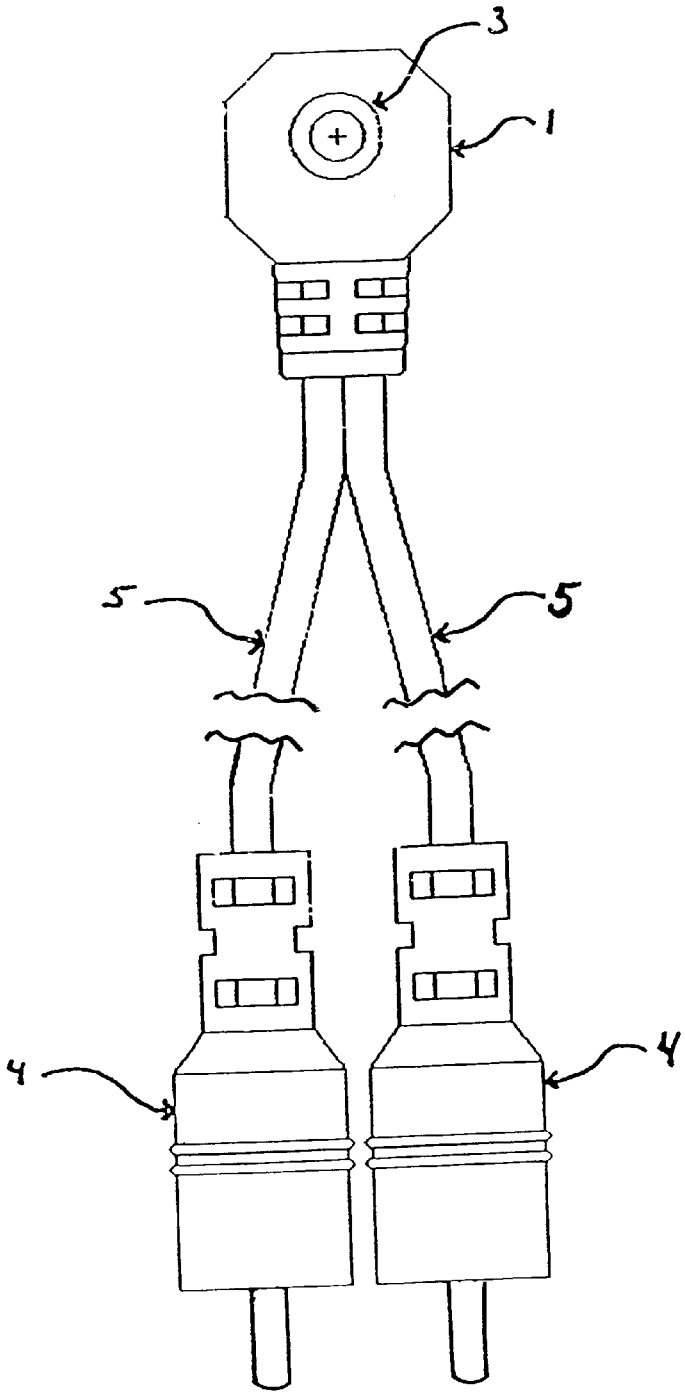
FIG. 1 is a front view of the preferred embodiment of the device.

The present invention will now be described more fully, hereinafter, with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring now to the figures, one can readily see the design of this adapter. In the preferred embodiment the device consists of five parts. A small molded plastic chassis (1) with electrical plug connections, as shown in FIGS. 1 through 4, forms the base of the adapter. The electrical plug connections contains an audio plug consisting of a 3.5 mm female stereo plug (2), a 3.5 mm male stereo plug (3), and two RCA male plugs (4) on cables (left and right) (5) extending from the molded plastic chassis (1). These electrical plug connections are well known to those skilled in the art and the length of the cables can vary without affecting the usefulness of the invention.

Figure 2:
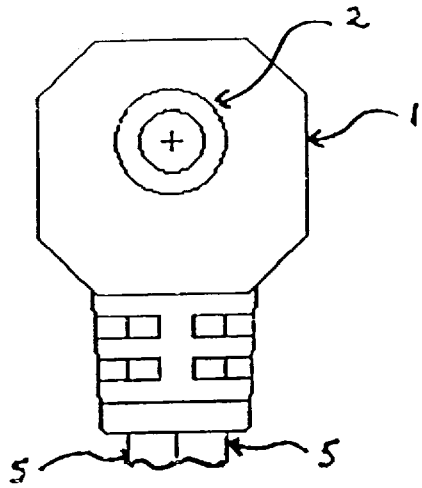
FIG. 2 is a rear view of the preferred embodiment of the device.
Figure 3:
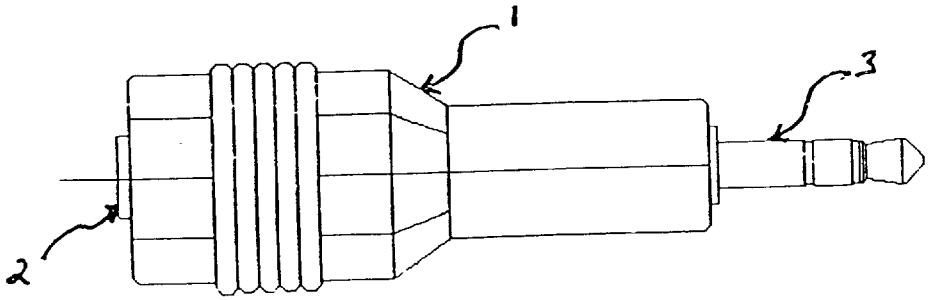
FIG. 3 is a top view of the preferred embodiment of the device.
Figure 4:
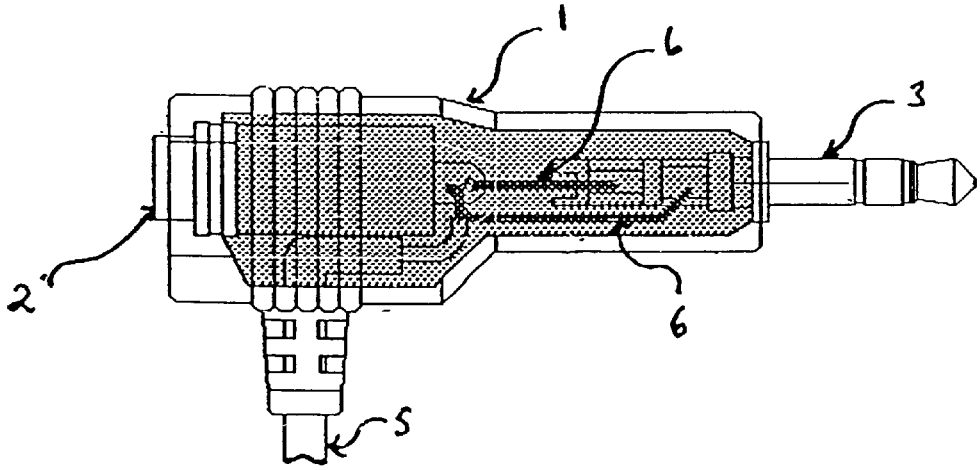
FIG. 4 is a side cut out view of the preferred embodiment of the device showing the internal connections.

Looking now at FIG. 1 the reader can see the male stereo plug (3) is located on what can be considered to be the front of the molded plastic chassis (1). FIG. 2 shows the female stereo plug (2) located on the back of the molded plastic chassis (1). FIG. 4 shows the internal view of the device, and that the male stereo plug (3) and the female stereo plug (2) are electrically connected, by soldered wire connections (6).

FIGS. 1, 2 and 4 show the location of the two cables (5) having male RCA plugs (4) on one end and are soldered to soldered wire connections (6) on the back of the male stereo plug (3) as more clearly shown in FIG. 4. The two cables (5) extend from the bottom of the molded plastic chassis (1) as shown in FIGS. 1 and 2 and can be a variety of lengths to accommodate varying distances from the computer to the user's home audio equipment.

To use the device the male stereo plug (3) would be inserted into the standard 3.5 mm female stereo jack (not shown) on the soundcard of a personal computer, and is used to split the signal coming from the personal computer 3 ways (male stereo plug (3) to female stereo plug (2), and to left and right RCA male plugs (4) on the end of the cables(5)). This gives the user the ability to use standard computer speakers by connecting the device to a personal computer by inserting the male stereo plug (3) into to the typical female stereo jack (not shown) on the back of the personal computer, and then inserting the standard male plug of typical computer speakers into the female stereo plug (2) of the device, and then also connecting to standard home audio by connecting the right and left male RCA plugs (4) into the home audio system.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the dependent claims.

What is claimed is:

1. A one-piece adapting device used for connecting home audio equipment having a left input and a right input to a personal computer that has a stereo output used to connect personal computer speakers having a stereo input, said adapting device comprising of;

a male computer stereo plug;

said male computer stereo plug being sized to fit the stereo output of the personal computer and having a left output and a right output;

a female computer stereo plug;

said female computer stereo plug being sized to allow insertion of the stereo input of the personal computer speakers and having a left output and a right output;

said male computer stereo plug and said female computer stereo plug being electrically connected such that when said male computer stereo plug is inserted into the personal computer stereo output and the stereo input of the personal computer speakers is inserted into said female computer stereo plug proper electrical connection is made between the personal computer speakers and the personal computer stereo output;

a male home audio plug;

a cable a second male home audio plug;

a second cable; and, said male home audio plug being electrically connected through said cable to said left output of the stereo output of said male computer stereo plug and said second male home audio plug being electrically connected through said second cable to said right output of the stereo output of said male computer stereo plug such that when said male home audio plug is connected to left input of the home audio equipment and said second male home audio plug is connected to the right input of the home audio and said male computer stereo plug is inserted in the personal computer stereo output electrical connection is made between the home audio equipment left and right inputs and the personal computer stereo output.

2. The adapting device of claim 1 wherein:

said male computer stereo plug and said female computer stereo plug are 3.5 mm stereo plugs.

3. The adapting device of claim 1 wherein:

said male home audio plug and said second male home audio plug are RCA plugs.

* * * * *